United States Patent [19]

Spicer et al.

[11] 4,151,704

[45] May 1, 1979

[54] METHOD AND APPARATUS FOR LAYING UP ELONGATE MEMBERS

[75] Inventors: Lyndon R. Spicer, Monmouthsire, South Wales, Wales; Bernard C. Warren, Sidcup, England

[73] Assignee: International Standard Electric Corporation, New York, N.Y.

[21] Appl. No.: 909,240

[22] Filed: May 24, 1978

[51] Int. Cl.[2] ..... D07B 3/00

[52] U.S. Cl. ..... 57/13; 57/3; 57/352; 57/361

[58] Field of Search ..... 57/3, 6, 9, 13, 19, 57/25, 33, 34 R, 58.36, 58.38, 58.54, 58.63, 58.7, 58.83, 59, 62, 63, 64, 106, 111.5, 156, 160, 166

[56] References Cited

U.S. PATENT DOCUMENTS

| | | | |
|---|---|---|---|
| 1,382,258 | 6/1921 | Turgeon | 57/33 |
| 1,447,538 | 3/1923 | Fullington | 57/25 X |
| 1,774,880 | 9/1930 | Francis | 57/59 |
| 3,097,473 | 7/1963 | O'Grady et al. | 57/106 X |
| 3,098,342 | 7/1963 | Smith | 57/15 |
| 3,572,024 | 3/1971 | Lyons | 57/3 |
| 3,583,145 | 6/1971 | Fisher et al. | 57/106 |

*Primary Examiner*—Donald Watkins

*Attorney, Agent, or Firm*—Thomas L. Peterson

[57] ABSTRACT

A method of and apparatus for laying-up hoses and electrical cable cores in which the hoses and cores are initially laid out horizontally and threaded through tubes extending between a plurality of lay plates. The hoses and cores are pulled from the tubes while the lay plates are rotated synchronously to form a laid-up unit. The tubes are freely rotatable with respect to the lay plates, so that the hoses and cores are themselves twist free in the laid-up unit. The horizontal arrangement avoids the need for the hoses to be wound on enormous bobbins and laid up using conventional laying-up techniques.

8 Claims, 3 Drawing Figures

METHOD AND APPARATUS FOR LAYING UP ELONGATE MEMBERS

BACKGROUND OF THE INVENTION

This invention relates to laying-up machines, and methods of laying-up elongate members, and in particular to machines for laying-up elongate members such as hoses, with or without electrical cores and other members.

Conventional laying-up machines require that the elongate members be initially wound onto bobbins before being mounted on the laying-up machines. The elongate members may be hoses, for example, which are of such a size and/or rigidity that bobbins of enormous size would be required to carry them and lay them up together with other such hoses, or electrical cable cores, or mechanical strength members, etc., using a conventional laying-up technique.

Hoses with such properties are used in umbilical cables in advanced saturation diving systems, which cables provide all the mechanical, electrical, and oxygen/-helium facilities required by deep-sea divers.

It is an object of the present invention to provide a laying-up machine which does not require the components to be laid up together, to be initially wound onto bobbins.

SUMMARY OF THE INVENTION

According to one aspect of the present invention, there is provided a laying-up machine including a plurality of lay plates spaced apart at intervals over a distance comparable with the length of the elongate members to be laid up. The lay plates are rotatable synchronously. Means is provided for moving the elongate members through and from the lay plates during rotation thereof whereby to form a laid-up unit from the elongate members.

According to another aspect of the invention, there is provided a method of laying up a plurality of elongate members into a single unit, comprising laying out the elongate members horizontally and threading them through respective apertures in a plurality of lay plates spaced apart at intervals over a distance comparable with the length of the elongate members. All the elongate members are pulled through and from the lay plates while synchronously rotating the lay plates. The laid-up unit so formed is then wound onto a take-up bobbin.

Preferably, tubes extend between the lay plates for support of the elongate members which in the use of the machine are threaded through the tubes and, preferably, also the tubes extend through the lay plates and are freely rotatable with respect thereto.

Conveniently, there is provided threading means which includes a tow line and a pair of tow-line bobbins associated with each tube, the bobbins being arranged at opposite ends of the tube.

DESCRIPTION OF THE PREFERRED EMBODIMENT

Figure 1:
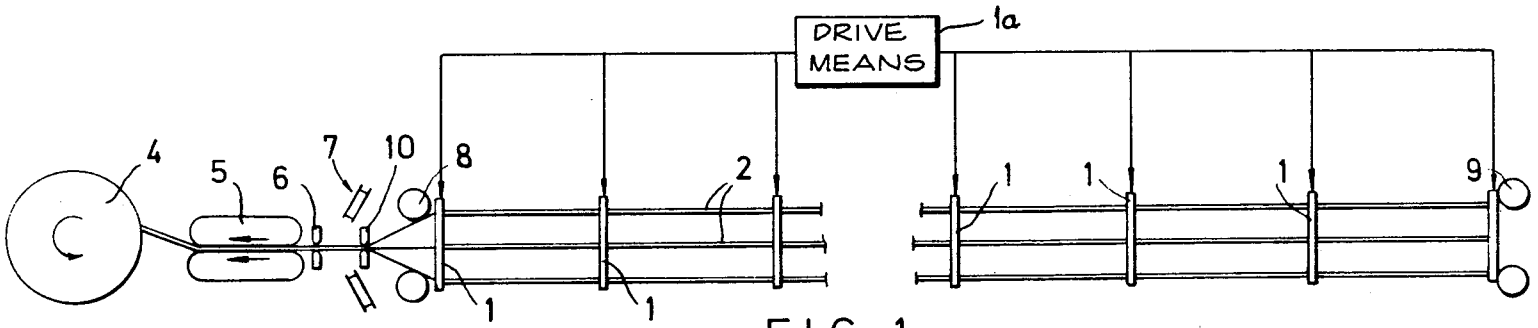
FIG. 1 shows, schematically, a laying-up machine according to an embodiment of the present invention, in side elevation.

The laying-up machine and method of the present invention are based on the principle of laying out the elongate members, to be twisted together, horizontally. These elongated members are threaded through a number of lay plates spaced at predetermined intervals apart. The lay plates are rotated synchronously while the elongate members are drawn through the apparatus by suitable take-up means. To avoid the formation of caternaries between the successive lay plates, the entire length of the elongate members can be threaded through tubes which extend through all the successive lay plates.

The embodiment of the laying-up machine shown in the drawing comprises a number of identical tube support discs 1 (lay plates) which are equi-spaced and extend over a distance comparable with the length of the elongate members which are to be twisted together. The discs 1 support hollow core support tubes 2 which extend there-between.

Figure 3:
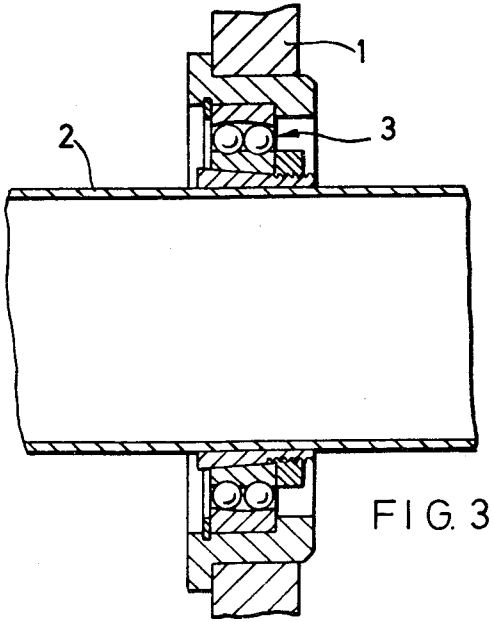
FIG. 3 is a sectional view through part of the tube support disc and an associated core support tube of the machine in FIGS. 1 and 2.
Figure 2:
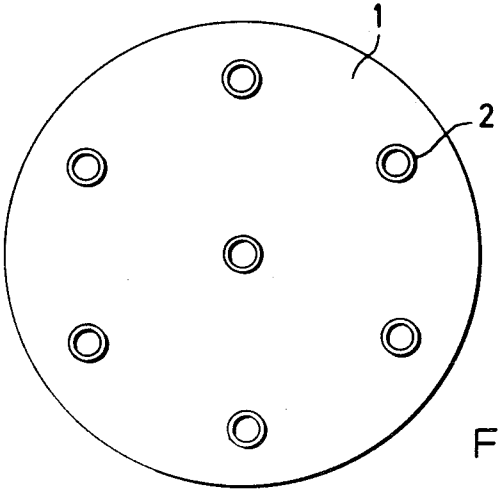
FIG. 2 shows, somewhat schematically, an end view of a tube support disc of the machine of FIG. 1 with core support tubes extending therethrough.

As can be seen clearly from FIG. 3, the core support tubes 2 are mounted in the discs 1 via bearings 3, so that the core support tubes 2 are freely rotatable with respect to the discs 1. The discs 1 are driven synchronously either by individual drive means or in groups. Such synchronous drive means is shown schematically in FIG. 1 and indicated 1*a*.

At the take-up end of the machine is a take-up drum 4, a haul-through device 5, a forming die 6, a tape lapping machine with heads 7, and a forming die 10.

Associated with each tube 2 is a device for pulling an elongate member into it prior to laying up. The device comprises tow-line bobbins 8 and 9, between which extends a tow line and on each of which may be wound a length of the tow line. The ends of tow line are firmly secured to the respective bobbins. Means are provided where an elongate member can be hooked onto the tow line at the right hand (inlet) end of the machine and pulled into its respective tube by rotation of the bobbin 8 at the outlet (left hand) end of the machine. The tow line may alternatively be an endless belt or line passing around both bobbins 8 and 9 and provided with means for hooking on the elongate members.

When the required elongate members are positioned in their respective tubes, the left-hand ends of the elongate members are collected together and drawn through the die 10, tape lapping heads 7, die 6, haul-through device 5 to the driven take-up drum 4. Once an initial length of the cable has been collected together and attached to the drum 4, laying-up proper may begin. As the haul-through device 5 pulls the elongate members from their respective tubes, the tube support discs 1 are rotated synchronously thereby laying-up the elongate members together, the cable being guided and formed by dies 6 and 10, and the applied twist held in place by the application of tapes by conventional tape lapping heads 7.

In order to remove the twist which would thus otherwise be given to each of the elongate members, during laying-up, the core tubes are freely rotatable as mentioned above. The weight of the elongate members themselves and the friction existing between them and the tubes serves to keep the elongate members in contact with the tubes so that the twist which would otherwise be induced in each elongate member by rotation of the lay plates in one direction, is negated by the rotation of the tubes in the opposite direction by virtue of their being freely rotatable. The individual elongate members are, therefore, themselves twist free in the laid-up cable assembly. The cable assembly emerging from the outlet end of the haul-through device may, alternatively, be passed through a plastic sheath extruder or other equipment prior to being wound onto the take-up drum.

The elongate members may, for example, be hoses for oxygen/helium supply, etc., electrical power cable cores, telecommunication cable cores and strength members, so that a saturation diving system umbilical cable may be laid up by the machine. The length of the tubes 2 will be dictated by various factors, the most basic being the maximum length of umbilical cable required to be laid-up on the machine. Typically, the tube support discs may be 3.5 m apart and the length of the tubes on the order of 500 m.

What is claimed is:

1. A machine for laying up elongate members comprising:

a plurality of lay plates spaced apart at intervals over a distance comparable with the length of the elongate members to be laid up;

means for rotating said lay plates synchronously about a center axis passing therethrough; and means for moving elongate members through and from the lay plates during rotation thereof whereby to form a laid-up unit from the elongate members.

2. A machine as set forth in claim 1 including:

hollow tubes extending through said lay plates for supporting the elongate members therein.

3. A machine as set forth in claim 2 wherein:

said tubes are rotatable in said lay plates.

4. A machine as set forth in claim 2 including:

means for threading elongate members through said tubes.

5. A machine as set forth in claim 4 wherein:

said threading means includes a two line and a pair of tow-line bobbins associated with each said tube; and said bobbins of each pair are located at the opposite ends of their corresponding tube.

6. A method for laying up a plurality of elongate members into a single unit comprising the steps of:

laying out the elongate members horizontally;

threading said elongate members through respective apertures in a plurality of lay plates spaced apart at intervals over a distance comparable with the length of the elongate members;

pulling all the elongate members through and from the lay plates while synchronously rotating the lay plates; and winding the laid-up unit so formed onto a take-up bobbin.

7. A method for laying up a plurality of elongate members into a single unit comprising the steps of:

laying out the elongate members over substantially their entire length in a parallel manner surrounding a center axis;

moving said elongate members longitudinally of said axis while synchronously rotating said members around said axis, but without twisting the individual elongate members; and collecting the elongate members to provide a laid-up unit.

8. A method as set forth in claim 7 including the additional steps of:

passing the laid-up unit through a die; and winding the laid-up unit onto a take-up bobbin.

* * * * *